US005664866A

United States Patent [19]

Reniger et al.

[11] Patent Number: 5,664,866

[45] Date of Patent: Sep. 9, 1997

[54] LIGHT ASSEMBLY

[75] Inventors: Bruce Reniger, Alto; Terry L. Lautzenheiser, Grand Haven; Brent A. Reichard, Greenville, all of Mich.

[73] Assignee: Attwood Corporation, Lowell, Mich.

[21] Appl. No.: 419,039

[22] Filed: Apr. 10, 1995

[51] Int. Cl.[6] ..... B63B 45/00

[52] U.S. Cl. ..... 362/61; 362/80; 362/310; 362/375

[58] Field of Search ..... 362/61, 80, 296, 362/310, 349, 370, 374, 375

[56] References Cited

U.S. PATENT DOCUMENTS

| | | | |
|---|---|---|---|
| D. 334,073 | 3/1993 | Wishoff | D26/28 |
| 1,794,160 | 2/1931 | Dodge . | |
| 2,871,342 | 1/1959 | Mappes . | |
| 3,043,949 | 7/1962 | Smith . | |
| 3,192,376 | 6/1965 | Najimian, Jr. . | |
| 3,656,105 | 4/1972 | Steltzer et al. | 340/119 |
| 4,245,281 | 1/1981 | Ziaylek, Jr. | 362/61 |
| 5,268,824 | 12/1993 | Czipri | 362/61 |
| 5,285,359 | 2/1994 | Czipri | 362/61 |
| 5,335,149 | 8/1994 | Evans | 362/61 |
| 5,339,225 | 8/1994 | Wiggerman | 362/61 |

OTHER PUBLICATIONS

Aqua Signal® Catalog, 1994.
"Boat Lighting and Accessories," Hellamarine, 1994.
"Perko® Navigation Lights Selection Chart,"1990.
2 pages of Perko Catalog, Feb., 1995.
Attwood Catalog, pp. 26–44, 1992–93.

*Primary Examiner*—James C. Yeung
*Assistant Examiner*—Alfred Basichas
*Attorney, Agent, or Firm*—Price, Heneveld, Cooper, Dewitt & Litton

[57] ABSTRACT

A navigation light assembly for a marine craft includes a base mountable to a deck or other suitable surface of a marine craft, a hemispherical lens which is sealingly attached to an interior wall in the base to form a water-tight space for containing a lightbulb and electrical contacts, and a cap which is attached to the base to securely capture the lens therebetween. A reflector disposed within the water-tight space of behind the lightbulb redirects light outward from the back of the assembly to provide efficient utilization of light emitted from the lightbulb to achieve better visibility of the light from a greater distance using a smaller lightbulb and light assembly. The efficient utilization of light from the lightbulb is further improved by employing a hemispherical Fresnel lens which focuses light along the horizon. The light assembly is easily mounted to the deck and assembled, and is free of exposed fasteners used to attach the assembly to the deck of a marine craft.

34 Claims, 7 Drawing Sheets

LIGHT ASSEMBLY

BACKGROUND OF THE INVENTION

This invention relates to a light assembly for a vehicle, and more particularly to a navigation light assembly for a marine craft.

Current international and U.S. inland navigation rules, which became effective Jun. 1, 1983, and Dec. 24, 1981 (except for the Great Lakes, wherein the rules became effective on Mar. 1, 1983), respectively, require that between sunset and sunrise, or any time visibility is limited, vessels must display a green starboard sidelight and a red port sidelight "each showing an unbroken light over an arc of the horizon of 112.5 degrees and so fixed as to show the light from right ahead to 22.5 degrees abaft the beam on its respective side." Vessels less than twenty meters in length can be provided with a single combined lantern having both port and starboard sidelights. For vessels between twelve and fifty meters in length, the sidelights must be visible for at least two miles (at least one mile for vessels less than twelve meters in length).

In order to meet the visibility requirements, currently available navigation lights are generally large, bulky, stainless steel fixtures which house a relatively large lantern or lightbulb capable of being seen for at least one or at least two miles depending on the length of the vessel to which it is to be mounted. Known navigation lights for marine vessels have generally been difficult to install, wire, assemble, and service, and have required a plurality of visible or exposed fasteners for securing the lights to a deck. More specifically, known navigation lights are generally mounted to the deck of a marine craft using a plurality of exposed fasteners, all of which must be removed in order to service the light, such as to replace a bulb having a damaged filament. It is also often necessary to remove internal fasteners in order to service known navigation lights. Assembly and reassembly during servicing of known navigation lights also often involves carefully holding a plurality of parts in precise alignment while simultaneously applying a fastener thereto. In addition, many of the prior known navigation lights have been less than adequate from a weather resistant standpoint, especially over extended service periods.

In addition to being large and bulky, known navigation lights typically have blunt surfaces and often include sharp edges or other features on which a person could stub his/her toes, trip over, or otherwise become injured.

The larger size and traditional shapes of navigation sidelights which are currently used are also not generally aesthetically compatible with modern, streamlined hull designs.

Accordingly, an object of the invention is to provide a smaller, less conspicuous navigation light which is watertight, weather resistant and durable, meets the two-mile visibility requirement, and which is easily installed and serviced.

SUMMARY OF THE INVENTION

The invention provides a compact navigation light assembly which meets the international and U.S. navigation visibility requirements, is easy to assemble and disassemble for installation or service, is compact, avoids dangerous sharp edges, has fasteners which are generally concealed after installation, is highly water and weather resistant to provide long service life, and is aesthetically pleasing and compatible with various modern marine craft.

In accordance with a first aspect of the invention, there is provided a navigation light assembly for a marine craft which includes a base adapted to be mounted to a marine craft, a lens, a cap, a bulb holder for retaining a lightbulb within the light assembly, and at least one reflector which redirects light emitted from a lightbulb through the lens and through an open area in the cap. The reflector, by redirecting light from the bulb through the lens and open area in the cap, helps to maximize utilization of light emitted from the bulb thereby allowing for the use of a lightbulb which consumes less energy and generates less heat, thereby allowing a smaller, more efficient light assembly.

In accordance with another aspect of the invention, there is provided a navigation light assembly for marine craft, which includes a base which is adapted to be mounted to a marine craft, and a lens which is securable to the base, and any of a plurality of interchangeable caps which cover and, together with the base, encapsulate and retain the lens, and which include an appropriate opening for allowing light to radiate from the navigation light assembly. In particular, the interchangeable caps include a cap having a port side opening, a cap having a starboard side opening, and a cap having a combination port and starboard opening.

In accordance with a still further aspect of the invention, there is provided a navigation light assembly for a marine craft which includes a base mountable to a deck on a marine craft, a lens securable to the base, a cap which, together with the base encapsulates and retains the lens, and a three-part reflector which maximizes utilization of light emitted from the bulb to permit compliance with minimum visibility requirements while using a small, low energy light bulb which generates low heat, thereby allowing for utilization of a compact light assembly which is generally much smaller and simpler in design than know navigation lights. The three-part reflector includes a back reflector which is disposed within the lens such that the lightbulb is generally interposed between the back reflector and the cap opening. The back reflector preferably has a concave, vertical reflective surface which faces the bulb and opening in the cap. The three-part reflector also includes a top reflector having a generally horizontal planar reflective surface facing and adjacent the top of the bulb, and a lower reflector having a generally horizontal planar reflective surface facing and adjacent the bottom of the bulb.

In accordance with a preferred mode of practicing the invention, the base is provided with bayonet mounts which are received in and lockingly engage perimeter flanges on the lens. Desirably, the base has a substantially flat bottom which facilitates mounting of the base to a deck or other flat surface of a marine craft. The lens is preferably a hemispherical lens having a circumferential groove along its edges which is adapted to receive an O-ring for sealing between the circumferential edges-of the lens and an interior wall of the base.

The navigation light assembly of the present invention preferably includes a two-part lightbulb holder, with each part being made of an electrically conductive material and having an integral electrical connector projecting outwardly through a slot in the base to allow easy plug-in connection with an electrical connector wired to an electrical supply on the marine craft. Desirably, the reflector or reflectors are integral parts of the bulb holder. The outwardly projecting electrical connectors also preferably include a resilient, flexible barb which will engage an outer surface of the base adjacent to the slot through which the electrical connector projects to secure the combination bulb holder/electrical connector to the base.

The cap is preferably provided with a resilient, flexible depending arm having a forwardly facing prong which engages a rearwardly facing prong on the base to secure the cap onto the base. The base engaging barbs on the bulb holder/electrical connectors, the flanges on the lens which engage bayonet mounts on the base, and the engaging prongs on the cap and base facilitate quick and easy assembly of the light without having to hold individual components in alignment with each other before fastening them together. A single, substantially concealed fastener, is used to lock the prongs on the cap and base together to complete assembly of the light.

The base is easily mounted to a deck using threaded fasteners which are concealed after installation. A hemispherical lens is sealingly attached to an interior wall in the base to form a water-tight space containing a lightbulb and electrical contacts, while a cap is attached to the base to securely capture the lens therebetween. The cap has a cut-out area to expose an appropriate portion of the lens depending on whether the light assembly is being used as a port sidelight, a starboard sidelight, or a combination port and starboard sidelight. A unique reflector which doubles as a bulb holder is disposed within the hemispherical lens behind, above and beneath the lightbulb to redirect light emitted from the bulb through the lens and through the cutout area of the cap. Thus, utilization of light emitted from the bulb is optimized to meet or exceed the two mile visibility requirement with a compact light assembly.

The navigation light assembly of the invention includes numerous features which facilitate assembly and installation on a marine craft deck, provide a water-tight enclosure for the lightbulb, seal the deck opening through which the light assembly is wired to the electrical system of the marine craft, achieve outstanding visibility in a compact, aesthetically pleasing light assembly, and simplify fabrication of the components of the light assembly to achieve all of the foregoing advantages at a relatively low cost. The light assembly of the invention is also easy to service, durable, free of blunt surfaces and sharp edges, free of exposed fasteners used to attach the light assembly to the deck of a marine craft, and has a smooth, relatively inconspicuous appearance which is compatible with modern, streamlined hull designs.

These and other features, objects, and benefits of the invention will be recognized by those who practice the invention and by those skilled in the art, from the specification, the claims, and the drawing figures.

DESCRIPTION OF THE PREFERRED EMBODIMENTS

Figure 1:
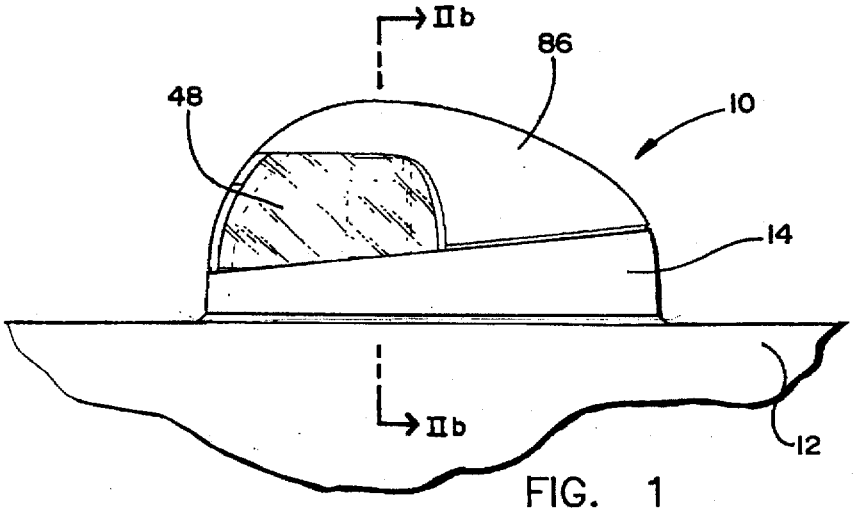
FIG. 1 is a side elevational view of a light assembly in accordance with the invention mounted to a deck of a boat.

There is shown, in FIG. 1, a navigation light assembly 10 incorporating the present invention and mounted to a deck 12 of a marine craft. In accordance with a preferred aspect of the invention, the fasteners used to secure the navigation light assembly 10 to the deck 12 are concealed within the light assembly. Also in accordance with a preferred aspect of the invention, the navigation light assembly 10 has a semi-ovate shape which is substantially free of any blunt surfaces or sharp edges to reduce the risk of a person stubbing his/her toes, tripping, or otherwise being injured by the navigation light assembly.

Figure 2A:
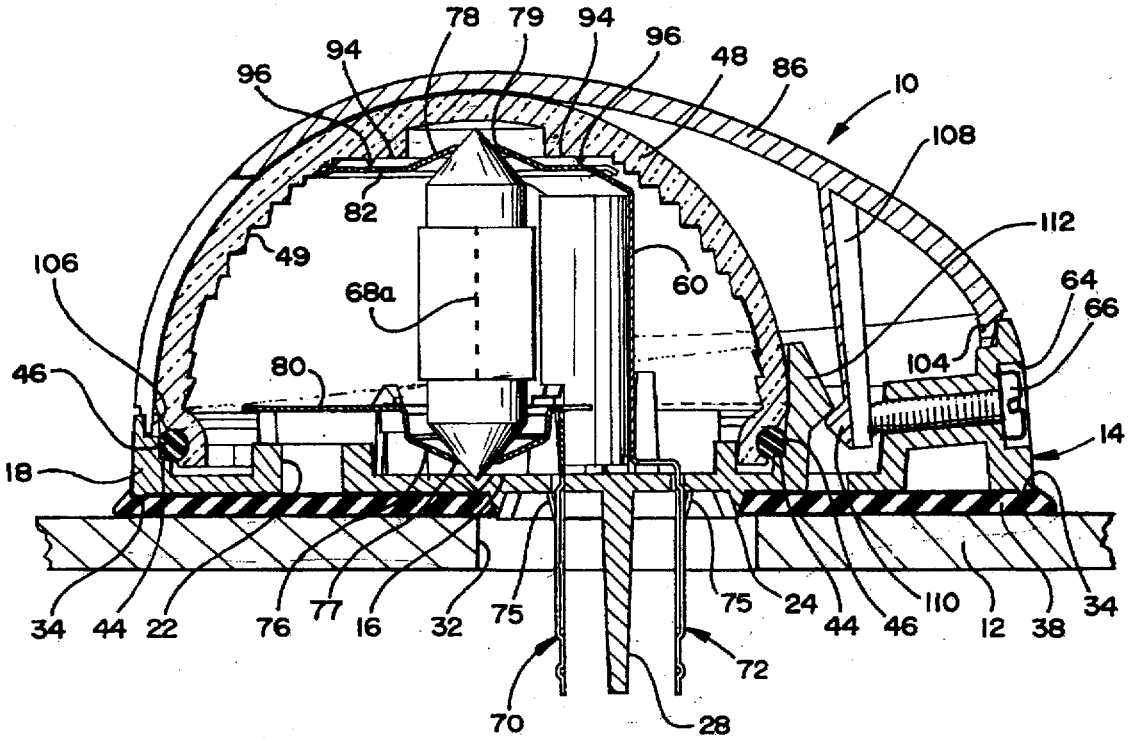
FIG. 2*a* is a side elevational cross-sectional view of the light assembly shown in FIG. 1.
Figure 2B:
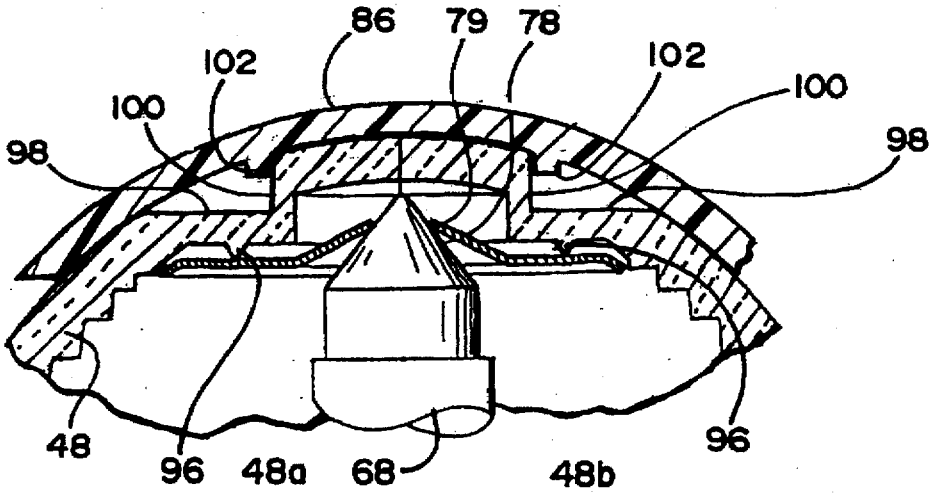
FIG. 2*b* is a fragmentary elevational cross section of the light assembly, as viewed along lines IIb—IIb of FIG. 1.
Figure 4C:
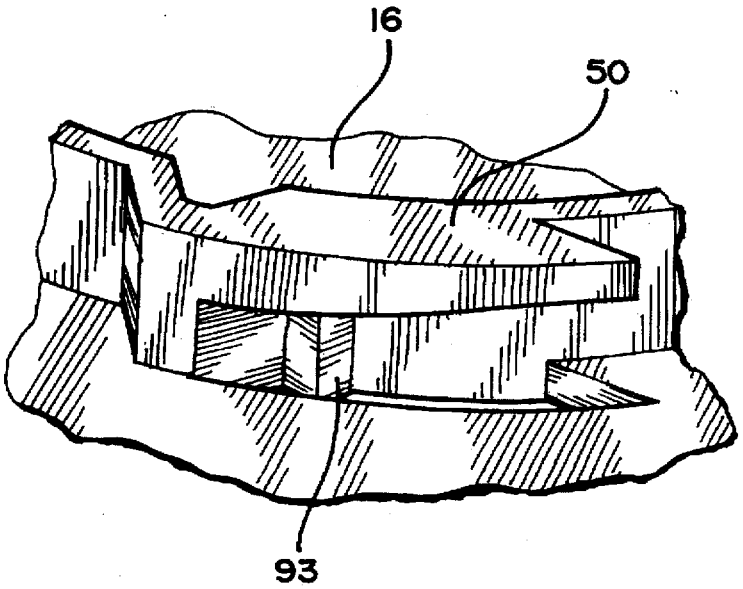
FIG. 4*c* is an enlarged fragmentary perspective view along lines IVc—IVc of FIG. 4*a*, showing a detent on a bayonet mount which helps ensure proper assembly of the light.

Referring to FIGS. 2*a*–4*a*, the navigation light assembly 10 includes a base 14 having a substantially flat bottom or floor 16, a curved, upstanding outer perimeter wall 18, a substantially circular inner wall 20, and fastener openings 22 for receiving threaded fasteners to secure the base 14 a deck 12 of a marine craft. The underside of the base 14, as best seen in FIGS. 2 and 4*b*, has a circular boss 24 with inclined circumferential edges 26 and a depending flange 28, also with inclined side edges 30 which merge into the inclined edges 26 of the circular boss 24. The flange 28 and boss 24 help align and properly position the base 14 over an opening 32 in the deck 12 to permit wiring of the navigation light assembly 10 to the electrical system of the marine craft. The lower edges 34 of the outer perimeter wall 18 extend downwardly beyond the underside of the floor 16 to provide a recessed area 36 on the underside of the base 14 which is adapted to receive a gasket 38 of rubber or synthetic resinous material which provides a water-tight barrier between the deck opening 32 and the light assembly 10. Flange 28 also helps protect electrical connectors 70 and 72 from being inadvertently bent such as during installation of the light assembly 10 onto a deck 12 of a marine craft, while insulating and preventing contact between those connectors. The interior side of the substantially circular inner wall 20 includes a circumferential shoulder 44 which acts as a seat for an O-ring 46 of neoprene butyl rubber which provides a water-tight seal between the outer edges of a hemispherical lens member 48 and the inner surface of the outer perimeter wall 18 to prevent water from entering the interior space defined by the hemispherical lens member and the base.

Circumferentially disposed on the top side of base 14 within a recessed area bounded by the substantially circular inner wall 20 are a plurality of bayonet mounts 50 having inclined undersides 51 (FIG. 4*a*) which wedge inwardly projecting, perimeter flanges 52 of lens member 48 when the hemispherical lens member is properly aligned on the base and rotated. Two slots 54 and 56 (FIG. 4*a*) are provided at the bottom or floor 16 of base 14 for receiving and securing the connector tabs 70, 72 of electrical connectors 40, 42, respectively, through the base. A pair of spaced upstanding members 58 rising from the bottom or floor 16 of base 14 between slots 54 and 56 help properly position and support electrical connector 42, and the integral reflector 60 and integral bulb retainer/electrical contact and upper reflector 62 thereof. A counter-sunk threaded opening 64 passes through the outer perimeter wall 18 of base 14 and is adapted to receive a threaded fastener 66 which securely fixes the various components of the navigation light assembly 10 together, as is explained more fully below.

The electrical connectors 40 and 42 together help retain a double festoon lightbulb 68, and provide a continuous electrical conductor from the respective terminals of the double festoon lightbulb to the depending, wiping-type, electrical connector tabs 70 and 72 which have generally planar electrical contact surfaces adapted to plug into and slidingly mate with a female electrical receptor wired to the electrical system of a marine craft. Each of the electrical connector tabs 70 and 72 have bosses or raised ribs 74 which improve both electrical and mechanical connection with a female electrical receptor. Bent tabs or barbs 75 extend outwardly at an angle from each tab 70, 72 to retain the tabs, and thus connectors 40, 42 in position after tabs 70, 72 are pushed through slots 54, 56. Barbs 75 are sufficiently resilient to pass through the slots and expand outwardly to engage the underside of the base adjacent each slot after such insertion. Barbs 75 can be pushed inwardly for removal of the connectors for service or repair.

The electrical connectors 40 and 42 each also include a recessed, frustoconical, electrical contact section 76 and 78, respectively, which achieve electrical contact with respective pointed, conical ends of a double festoon lightbulb 68. Apertures 77, 79, respectively, are provided in bulb contact sections 76, 78 to center and position light bulb 68 substantially parallel to and on the axis of the curved, cylindrical surface of rear reflector 60. Preferably, in this position, the bulb filament 68*a* will also be parallel to rear reflector 60 surface. Electrical connectors 40 and 42 have generally horizontally positioned, highly polished lower and upper reflector portions 80 and 82, respectively. As explained more fully below, reflectors 60, 80, and 82 combine to redirect light emitted from bulb 68 outwardly through lens member 48 and from the light assembly 10 through an opening 84 in a cover or cap member 86.

Figure 3:
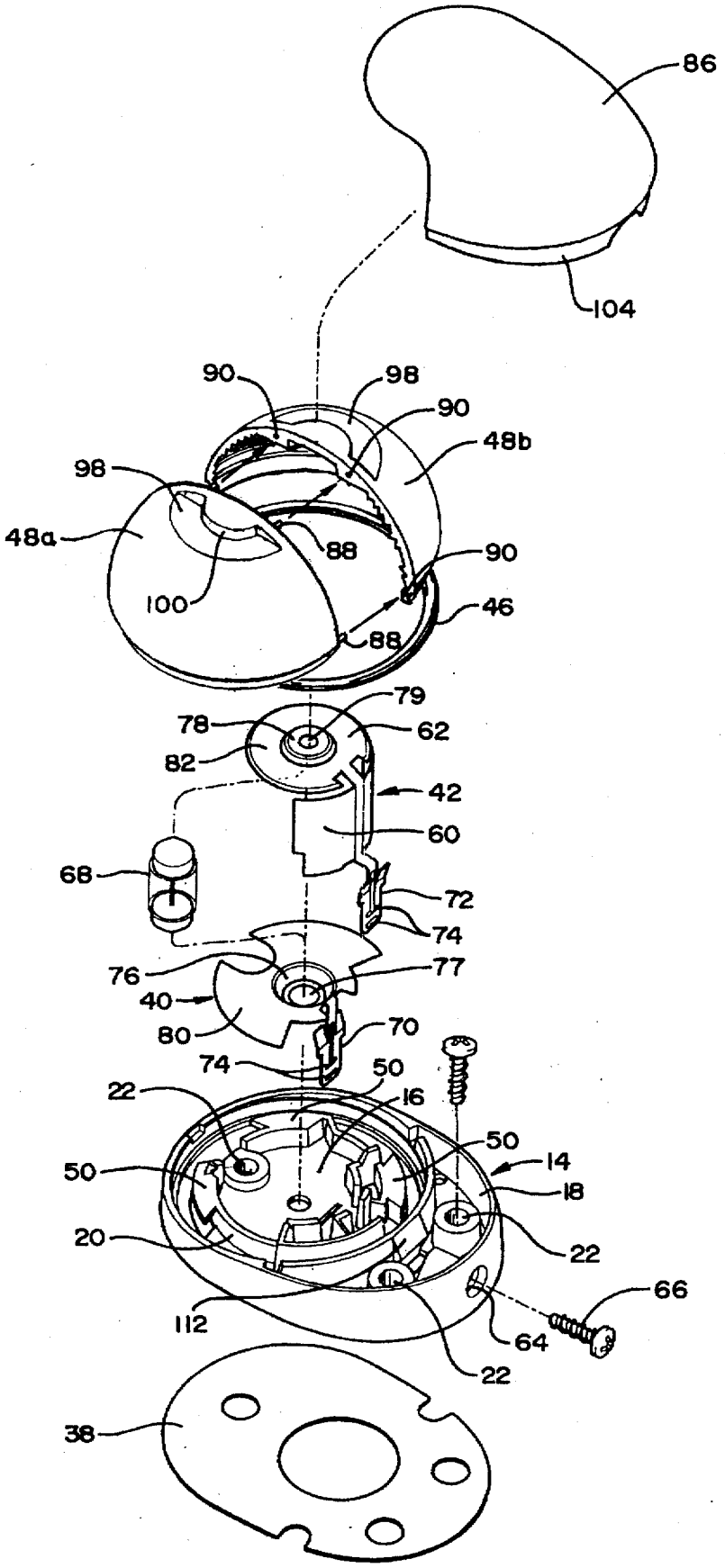
FIG. 3 is an exploded perspective view of the light assembly shown in FIG. 1, which shows how the various components thereof are assembled.
Figure 4A:
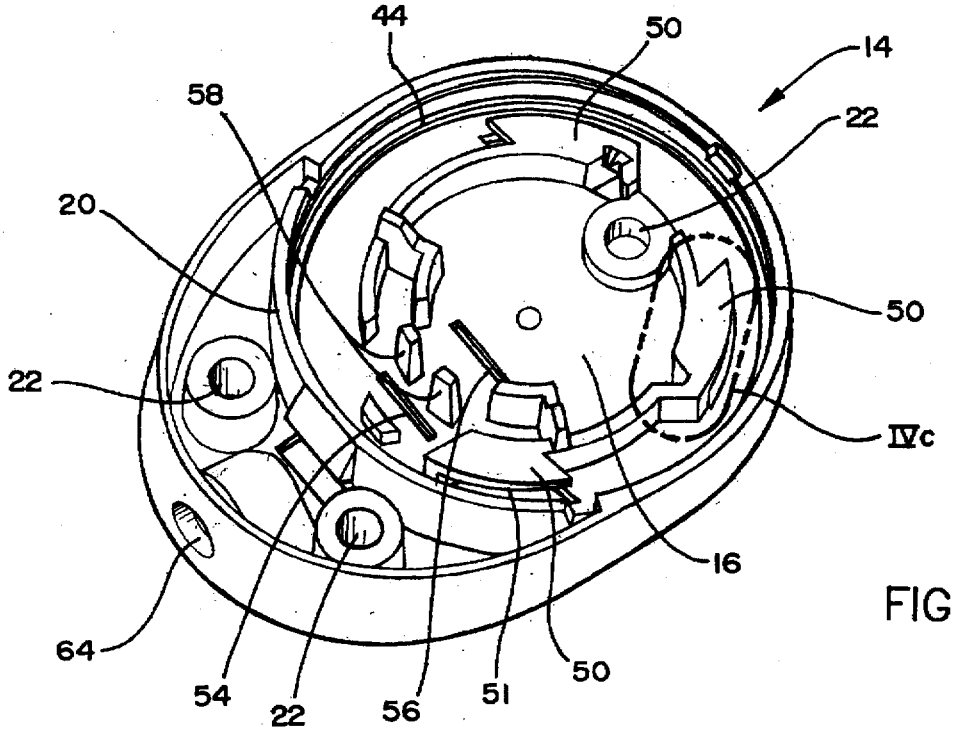
FIG. 4*a* is a top perspective view of the base of the light assembly shown in FIG. 1.
Figure 4B:
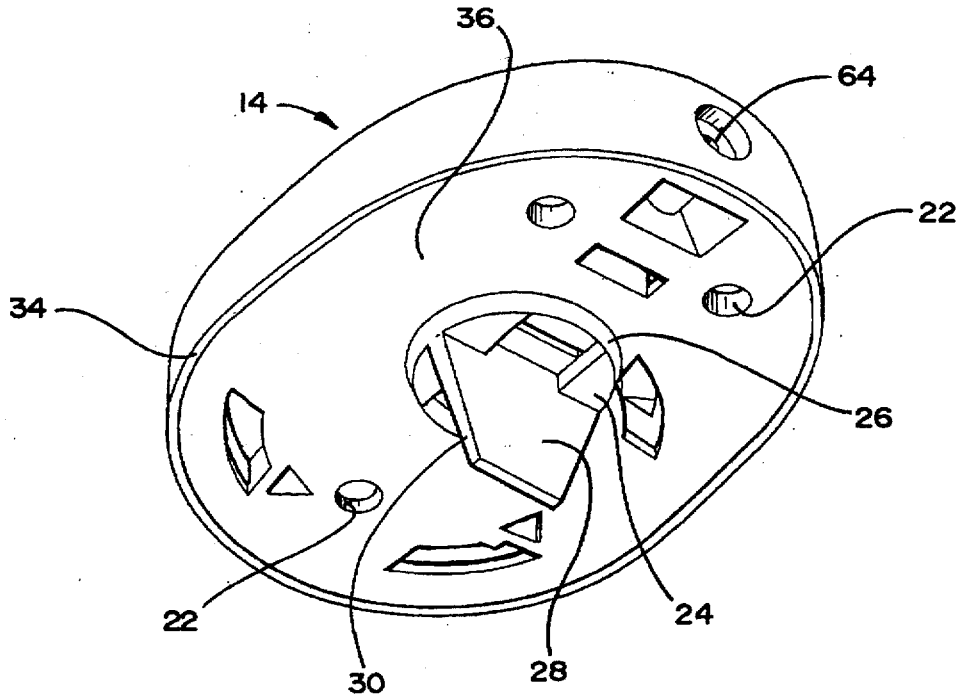
FIG. 4*b* is a bottom perspective view of the base shown in FIG. 4*a;*

The hemispherical lens member 48, as best seen in FIG. 3, has a multi-faceted inner surface 49 which forms a polyprismatic or Fresnel lens which focuses or directs light emitted from the bulb outwardly from the light assembly 10 in a generally horizontal direction. The use of a Fresnel lens 48 in combination with reflectors 60, 80, and 82 allows efficient utilization of the light emitted from bulb 68, which in turn allows compliance with the two mile visibility requirement using a smaller light assembly and lower wattage bulb than in prior known light assemblies.

Figure 7:
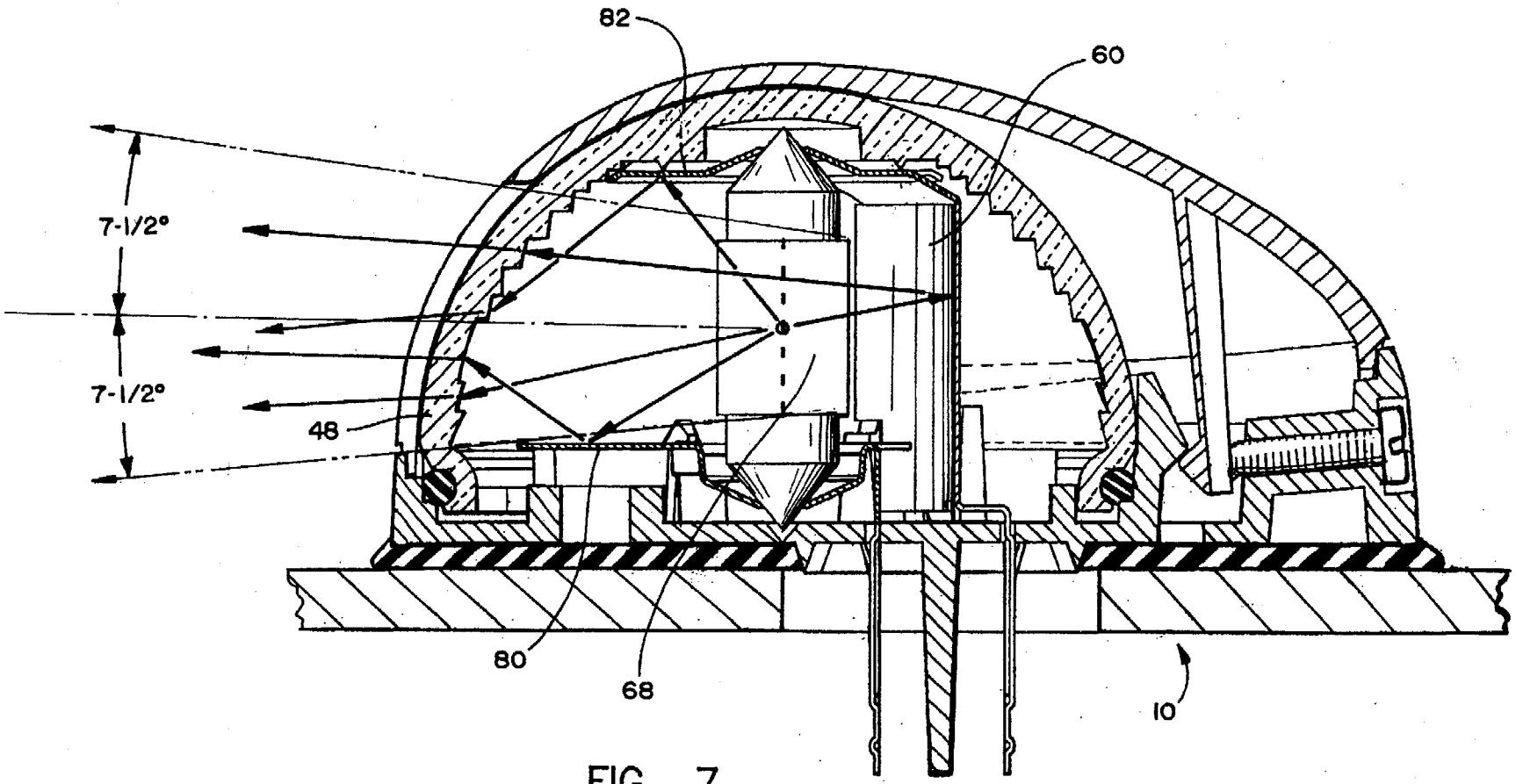
FIG. 7 is a diagram showing how light is reflected off of the back, top and bottom reflectors and out through the lens of the light assembly shown in FIGS. 1 and 2.

FIG. 7 shows how light emitted from bulb 68 is reflected off the rear 60, top 80 and bottom 82 reflectors and out through lens 48 of light assembly 10. The beam of light passing outward from the lens 48 of the light assembly 10 extends about 7.5 degrees upwardly and downwardly from a horizontal plane as shown in FIG. 7.

Figure 5A:
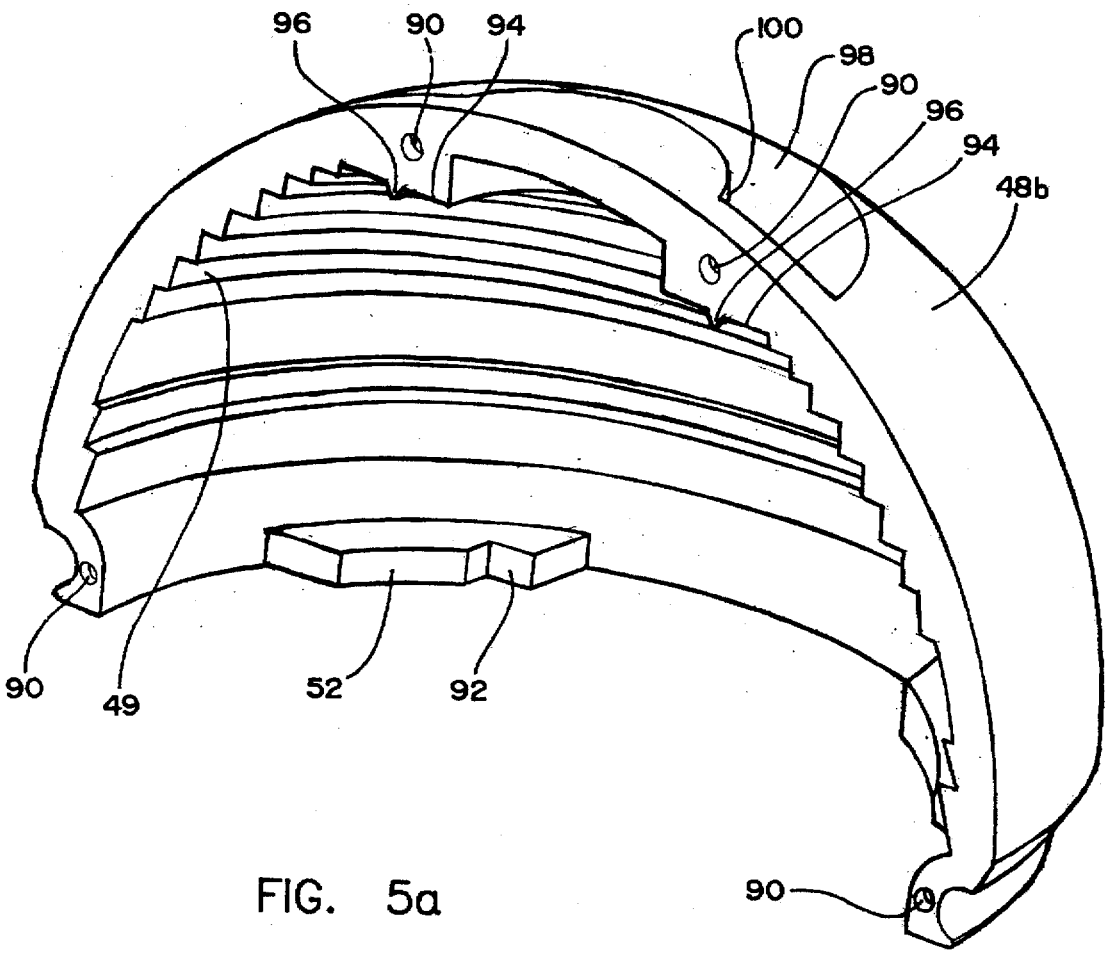
FIG. 5*a* is a rear perspective view of a Fresnel lens half used in the light assembly shown in FIG. 1.
Figure 5B:
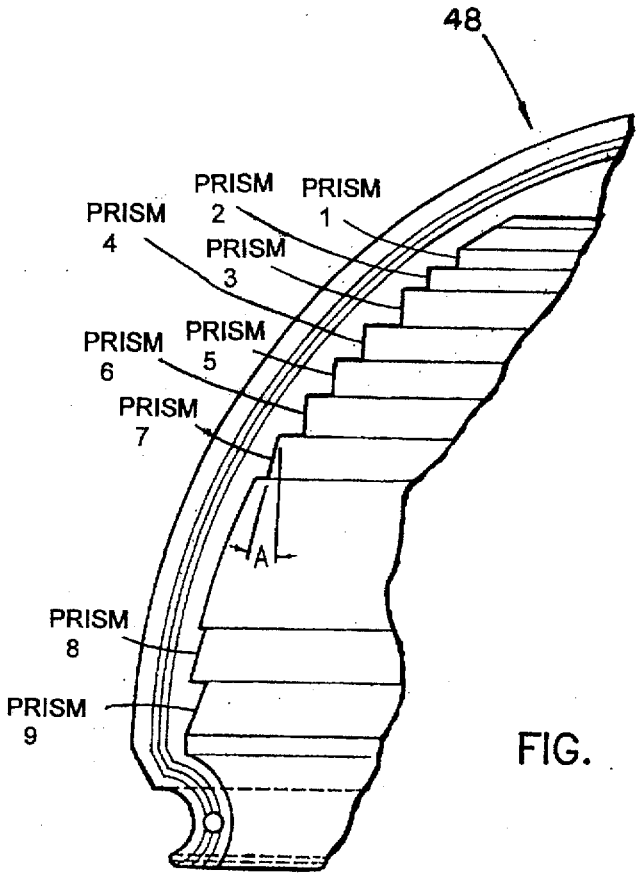
FIG. 5*b* is an enlarged, fragmentary, cross-sectional view showing details of the prismatic surfaces of a preferred Fresnel lens for use with the invention.

Details including the dimensions of the various prismatic surfaces of a preferred Fresnel lens for use with the invention are shown in FIG. 5*b*. The angles "A" between the vertical plane and a plane tangential to each of the lenses are set forth in the following table.

| Prism | "A" (degrees) |
|---|---|
| 1 | 0.5 |
| 2 | 0.5 |
| 3 | 0.5 |
| 4 | 0.5 |
| 5 | 0.5 |
| 6 | 0.5 |
| 7 | 15.0 |
| 8 | 15.0 |
| 9 | 20.0 |

As shown in FIG. 3, the hemispherical lens member 48 is preferably assembled from two separately formed halves 48*a* and 48*b*. Preparing the hemispherical lens member 48 from two separately formed halves 48*a* and 48*b* has several advantages. First, it is easier and less expensive to form two separate halves by an injection molding process and subsequently combine the two halves to form a continuous hemispherical lens member, than to form the hemispherical lens member in a single injection molding operation. More importantly, the lens member 48 can and preferably will, be formed from halves 48*a* and 48*b* which are made of different materials. For example, in the case of a port sidelight, the left half 48*a* is preferably made of a clear, transparent material which is tinted red, while the right lens half 48*b* can be made of a different material such as a light colored opaque material. In the case of a starboard sidelight, the left lens half 48*a* could be made of any suitable material such as a light colored opaque material, and the right lens half 48*b* would be made of a clear, transparent material having a green tint. Finally, in the case of a combination sidelight, the left lens half 48*a* would be made of a clear, transparent material having a red tint, and the right lens half 48*b* would be made of a clear, transparent material having a green tint. Alternately, and preferably, the combined red/green lens combination 48*a*, 48*b* could be interchangeably used in all three versions of the light assembly simply by changing the cap 86 as explained below.

As shown in FIGS. 3 and 5, the left lens half 48*a* includes a plurality of projecting pins 88 which are adapted to mate with a plurality of openings 90 on the right lens cap 48*b*. The pins 88 and openings 90 on the left and right lens halves 48*a* and 48*b* facilitate proper alignment to aid in the preparation of lens member 48.

One of the plurality of inwardly projecting flanges 52 on at least one of the lens halves is provided with a notch 92 (FIG. 5*a*) which cooperates with a detent 93 (FIG. 4*c*) on one of the bayonet mounts 50 of base 14, to prevent the lens member 48 from being improperly mounted onto the base 14. An internal circumferential shoulder 94 near the top of lens member 48 has a downwardly projecting circumferential ridge 96 which applies uniform pressure to the back or upper surface of the upper reflective portion 82 of electrical connector 42 (FIG. 2*a*) to insure that proper electrical contact is maintained between the opposing conical terminals of double festoon bulb 68 and the frustoconical contacts 76 and 78. Shoulders 98 having radially inwardly projecting upright walls 100 are provided near the top of each of the lens halves 48*a* and 48*b*. The upright walls 100 are engaged by curved raised ribs 102 (FIGS. 2*b*and 6*a*) on the interior roof of cap member 86 when cap 86 is installed as in FIG. 2*a* to help properly align the cap member with the lens member 48 during assembly or servicing of the navigation light assembly 10. In the event lens 48 is not properly mounted or seated in bayonet mounts 50, ribs 102 prevent cap 86 from properly mating with the lens thereby notifying the installer that an adjustment is needed.

Figure 6A:
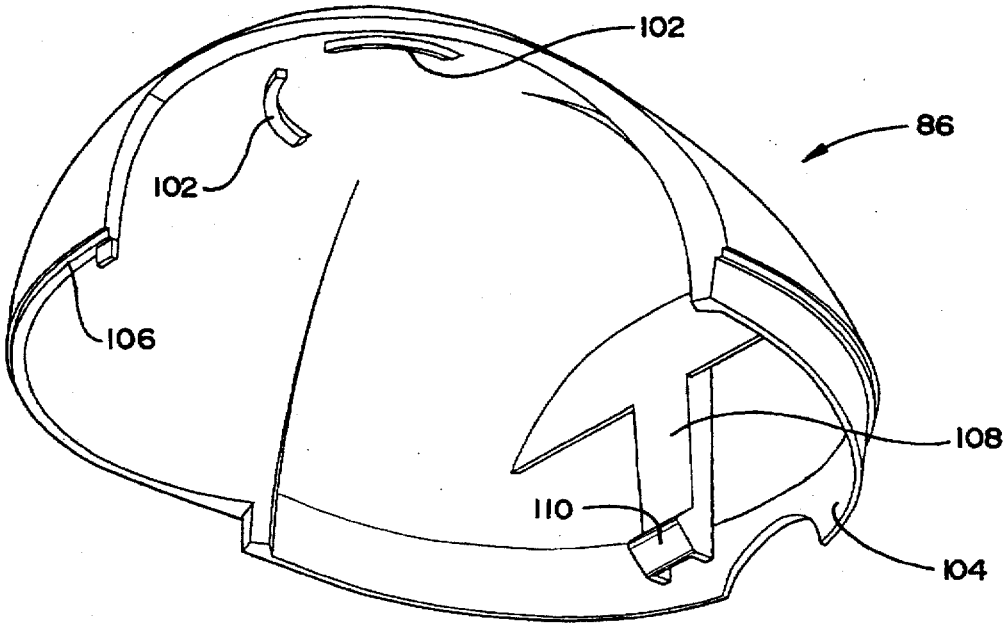
FIG. 6*a* is a bottom perspective view of a cap for use on a port side navigational light assembly in accordance with the invention.
Figure 6B:
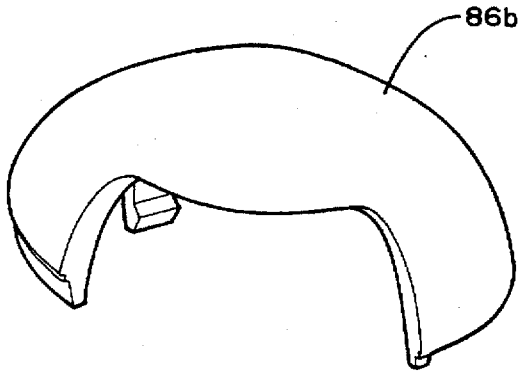
FIG. 6*b* is a top perspective view of a cap for use on a starboard side navigational light assembly in accordance with the invention.
Figure 6C:
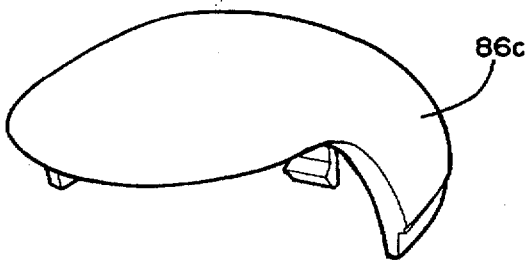
FIG. 6*c* is a top perspective view of a cap for use on a combination bi-color light assembly in accordance with the invention.

FIGS. 6*a*, 6*b*, and 6*c* show a cap for use on a port side 86, starboard side 86*b*, and combination sidelight assembly 86*c*, respectively. Cap member 86 has an overall helmet-like shape with an appropriate cutout section at the front of the cap which allows light to be emitted from the bulb 68 and through the lens member 48. The rear of the cap member 86 has a depending skirt 104 which telescopes within and generally abuts the interior surface of curved outer perimeter wall 18 (FIG. 2*a*) which aids in properly aligning and retaining the cap 86 on the base 14. A forward peripheral rim 106 seats against the remainder of the inner surface of the outer perimeter wall 18 to help align and properly secure the cap 86 onto the base 14. Cap member 86 also includes a resilient, relatively flexible, depending latch arm 108, the lower end of which has a forwardly projecting prong 110 which engages a rearwardly projecting prong 112 on the outer side of wall 20 to temporarily hold the cap 86 in place until a fastener 66 is inserted into the opening 64 to firmly lock prong 110 and prong 112 together.

Cap member 86 and base 14 can be formed of a variety of materials, but are preferably each made from a strong, durable thermoplastic material such as ABS or polycarbonate. Cap 86 and base 14 are each preferably made by injection molding. The clear, transparent portion or portions of lens 48 are preferably made of a strong, durable thermoplastic material having excellent optical clarity, such as polycarbonate or polymethylmethacrylate. Any remaining portion of the lens member which need not be transparent can be made of any suitable thermoplastic material. If the two halves 48*a* and 48*b* of the lens member 48 are made of different materials, it is preferred that the materials be compatible so that they can be fused together such as by an adhesive/sealant or by using ultrasonic welding techniques. The electrical connectors 40 and 42 can be made of any suitable electrically conductive material, but are preferably made of stainless steel because of its combination of electrical conductive properties and corrosion resistance. Additionally, stainless steel is advantageously employed in the fabrication of the connectors having integral reflective surfaces because of its excellent reflective properties.

Assembly of the navigation light 10 can be best understood with reference to FIG. 3 which shows the various components of the light assembly. The electrical connectors 40 and 42 are first secured to the base 14 by inserting electrical connector tabs 70 and 72 through slots 54 and 56, respectively, such that barbs 75 spring outwardly and hold the tabs/connectors in position. The base 14 is then mounted over an opening 32 in the deck 12 such as with threaded fasteners inserted through fastener openings 22 in the base 14. A gasket 38 is preferably disposed between the deck 12 and the base 14 before the base is fastened onto the deck. A double festoon bulb 68 is then snapped into position between the frustoconical contacts 76 and 78. An O-ring 46 is then placed within a lower circumferential groove 116 in the lens member 48. The lens member 48 is then inserted onto the base 14 and rotated to firmly seat the inwardly projecting flanges 52 within the bayonet mounts 50 and engage ridge 96 on the lens with the outer surface of upper reflector 82 on electrical connector 42. Next, cap member 86 is attached to the base by fitting the rear depending skirt 104 within the outer perimeter wall 18 of the base 14 and seating the peripheral rim 106 around the remainder of the outer perimeter wall 18. This causes ribs 102 inside cap 86 to engage shoulders 98. The forwardly projecting prong 110 on the cap 86 engages the rearwardly projecting prong 112 on the base 14 to temporarily secure the components of the light assembly 10 together. Assembly is completed by screwing a threaded fastener 66 into the threaded opening 64 to lock the prongs 110 and 112 together thereby firmly securing together all of the various components of the light assembly 10, while concealing all fasteners except fastener 66 which is inconspicuously positioned at the rear of the assembly.

It will be understood by those who practice the invention and by those skilled in the art, that various modifications and improvements may be made to the invention without departing from the spirit of the disclosed concept. The scope of protection afforded is to be determined by the claims and by the breadth of interpretation allowed by law.

The embodiments of the invention in which an exclusive property or privilege is claimed are defined as follows:

1. A navigation light assembly for marine craft, comprising:

A base having a substantially flat bottom to facilitate mounting thereof to a deck of marine craft;

a lens member adapted to be secured to said base;

a cap adapted to generally cover, and together with said base, encapsulate and retain said lens;

at least one reflector which redirects light emitted from a light bulb to said lens member and through an open area in said cap; and a bulb holder for retaining a light bulb within said light assembly, said bulb holder being comprised of two parts, each of which is an electrical conductor or an electrical terminal of light bulb retained by said bulb holder.

2. The light assembly of claim 1, wherein said base includes bayonet mounts, and said lens includes perimeter flange members which are received in and lockingly engage said bayonet mounts to secure said lens to said base.

3. The light assembly of claim 1, wherein said lens includes an outer surface having a circumferential shoulder and said cap includes bosses on an inner surface thereof, said circumferential shoulder being adapted to engage said bosses to facilitate proper alignment and assembly.

4. The light assembly of claim 1, wherein said lens further includes on its inner surface a circumferential shoulder for mating engagement with said bulb holder.

5. The light assembly of claim 1, wherein said lens is a hemispherical-shaped lens.

6. The light assembly of claim 5, wherein said lens is formed of polycarbonate.

7. The light assembly of claim 1, wherein said base includes a generally circular interior wall adapted to receive circumferential edges of said lens.

8. The light assembly of claim 7, wherein said lens includes, along its circumferential edges, a groove adapted to receive an O-ring for sealing between the circumferential edges of said lens and said interior wall of said base.

9. The light assembly of claim 1, wherein said at least one reflector is an integral portion of one of said bulb holder parts.

10. The light assembly of claim 9, wherein said at least one reflector is disposed within said lens near a rear portion thereof such that a lightbulb when mounted within said light assembly is generally positioned between said open area in said cap and said at least one reflector, and wherein said one reflector has a generally concave vertical reflective surface which faces said open area in said cap.

11. The light assembly of claim 10, further comprising a bottom reflector having a horizontal reflective surface disposed below and facing the bottom of the lightbulb when mounted in said light assembly, and a top reflector having a horizontal reflective surface disposed above and facing the top of a lightbulb when mounted in said light assembly.

12. The light assembly of claim 10, further comprising electrical contacts which project outwardly through slots in said base, each of said contacts being integral with a corresponding part of said bulb holder.

13. The light assembly of claim 12, wherein said contacts have generally planar electrical contact surfaces adapted to slidingly and wipingly engage an electrical receptor.

14. The light assembly of claim 13, wherein each of said contacts include a flexible, resilient barb which extends outwardly at an angle from the planar electrical contact surfaces to engage an underside of said base adjacent to a corresponding one of said slots in said base.

15. The light assembly of claim 1, wherein said cap includes a resilient, relatively flexible depending arm having a projecting prong for engaging said base to hold said cap to said base.

16. The light assembly of claim 15, wherein said base includes a prong for mating engagement with said prong on said depending arm of said cap.

17. The light assembly of claim 16, wherein said base includes a fastener opening which is axially aligned with said arm of said cap, whereby a fastener can be inserted into said opening to urge said prong on said arm against said prong on said base to lock them together.

18. A navigation light assembly for marine craft, wherein said navigation light has a port and a starboard side corresponding with the port and starboard sides of a marine craft, comprising:

a base having a substantially flat bottom to facilitate mounting thereof to a deck of a marine craft;

a hemispherical lens member adapted to be secured to said base;

a bulb holder for retaining a light bulb within said light assembly;

a cap adapted to generally cover, and together with said base, encapsulate and retain said lens; and at least one reflector which redirects light emitted from a light bulb through said lens member and through an open area in said cap; and wherein said base includes bayonet mounts to secure said lens to said base.

19. The light assembly of claim 18, wherein said lens includes, along its circumferential edges, a groove adapted to receive an O-ring for sealing between the circumferential edges of said lens and said interior wall of said base.

20. The light assembly of claim 19, wherein said at least one reflector is disposed within said lens such that a lightbulb, when mounted within said light assembly, is generally positioned between said open area in said cap and said at least one reflector, and wherein said one reflector has a generally concave vertical reflective surface which faces said open area in said cap.

21. The light assembly of claim 20, further comprising a bottom reflector having a horizontal reflective surface disposed below and facing the bottom of the lightbulb when mounted in said light assembly, and a top reflector having a horizontal reflective surface disposed above and facing the top of a lightbulb when mounted in said light assembly.

22. A navigation light assembly for marine craft, comprising:

a base adapted to be mounted to a marine craft;

a lens member adapted to be secured to said base;

a cap adapted to generally cover, and together with said base, encapsulate and retain said lens;

a back reflector disposed within said lens such that a lightbulb, when mounted within said light assembly, is generally positioned between said open area in said cap and said at least one reflector, and wherein said one reflector has a generally concave vertical reflective surface which faces said open area in said cap; and a bottom reflector having a horizontal reflective surface disposed below and facing the bottom of the lightbulb when mounted in said light assembly, and a top reflector having a horizontal reflective surface disposed above and facing the top of a lightbulb when mounted in said light assembly.

23. The light assembly of claim 22 further comprising a bulb holder for retaining a lightbulb within said light assembly, said bulb holder including electrical contacts which project outwardly through slots in said base.

24. The light assembly of claim 23, wherein said base includes bayonet mounts, and said lens includes perimeter flange members which are received in and lockingly engage said bayonet mounts to secure said lens to said base.

25. The light assembly of claim 24, wherein said lens is a hemispherical lens.

26. The light assembly of claim 25, wherein said lens includes, along its circumferential edges, a groove adapted to receive an O-ring for sealing between the circumferential edges of said lens and said interior wall of said base.

27. The light assembly of claim 23, wherein said bulb holder is comprised of two parts, each of which includes one of said electrical contacts and each of which is an electrical conductor for an electrical terminal of a light bulb which is being retained by said bulb holder, each part of said bulb holder including at least one of said back, top or bottom reflectors as an integral portion of said bulb holder part.

28. A navigation light assembly for marine craft, comprising:

a base having a substantially flat bottom to facilitate mounting thereof to a deck of a marine craft;

a lens member adapted to be secured to said base; and a cap adapted to generally cover, and together with said base, encapsulate and retain said lens member, said base and said lens member being adapted to cooperate with any of a plurality of caps selectable from a group comprising a cap having a port side opening, a cap having a starboard side opening, and a cap having a combined port and starboard side opening; and wherein said lens member is comprised of two separately formed halves, said lens member has being selectable from a group comprising a lens member wherein at least one of said halves is tinted red when the selected cap has a port side opening, a lens member wherein at least one of said halves is tinted green when said selected cap has a starboard side opening, and a lens member wherein one of said halves is tinted red and the other of said halves is tinted green when said cap has a combined port and starboard side opening.

29. The light assembly of claim 28, further comprising at least one reflector which redirects light emitted from a lightbulb through said lens member and through said opening in a selected one of said caps, said reflector being disposed within said lens such that a lightbulb, when mounted within said light assembly, is generally positioned between said opening of said selected cap and said at least one reflector.

30. The light assembly of claim 28, wherein said lens member has a hemispherical shape.

31. The light assembly of claim 30, wherein at least one of said halves has at least one pin and the other of said halves has at least one opening adapted to receive said at least one pin, said pin and opening facilitating proper alignment of said halves.

32. A navigation light assembly for marine craft, comprising:

a base having a substantially flat bottom to facilitate mounting thereof to a deck of a marine craft;

a lens member sealingly secured to said base, said lens member and said base defining a sealed volume;

a cap covering, and together with said base, encapsulating and retaining said lens;

at least one reflector disposed within the sealed volume defined by said base and said lens, said reflector being configured to redirect light emitted from a light bulb through said lens member and through an open area in said cap; and a bulb holder disposed within the sealed volume defined by said base and said lens for retaining a light bulb within said light assembly.

33. The light assembly of claim 32 wherein said lens member includes an outer surface having a circumferential shoulder and said cap includes bosses on an inner surface thereof, said circumferential shoulder being configured to engage said bosses to facilitate proper alignment and assembly.

34. The light assembly of claim 32 wherein said lens member further includes on its inner surface a circumferential shoulder for mating engagement with said bulb holder.

* * * * *